US005751819A

United States Patent [19]

Dorrough

[11] Patent Number: 5,751,819

[45] Date of Patent: May 12, 1998

[54] LEVEL METER FOR DIGITALLY-ENCODED AUDIO

[76] Inventor: Michael L. Dorrough, 5221 Collier Pl., Woodland Hills, Calif. 91364

[21] Appl. No.: 506,391

[22] Filed: Jul. 24, 1995

[51] Int. Cl.[6] ..... H04R 29/00

[52] U.S. Cl. ..... 381/56; 381/12; 381/58; 381/119

[58] Field of Search ..... 381/12, 119, 56, 381/58

[56] References Cited

U.S. PATENT DOCUMENTS

| | | | |
|---|---|---|---|
| 4,528,501 | 7/1985 | Dorough et al. | 381/56 |
| 4,637,047 | 1/1987 | Haino | 381/58 |
| 4,839,584 | 6/1989 | Fukuda et al. | 381/56 |
| 5,266,908 | 11/1993 | Koulopoulos et al. | 331/2 |

*Primary Examiner*—Forester W. Isen
*Attorney, Agent, or Firm*—J. E. McTaggart

[57] ABSTRACT

For professional audio operations such as recording and broadcasting, an LED bar-graph display instrument monitors average and peak loudness levels of stereophonic audio signals that have been encoded in serial digital format such as AES/EBU digital audio format. Internal audio processing circuitry, that can be implemented digitally with a custom chip gate array set, receives as input a serial stream of digital stereo audio data and converts this to ballistically conditioned logarithmic average and peak levels which are simultaneous displayed, generally simulating the ballistics of contemporary standard electronically displayed loudness meters such as the Dorrough analog model. The peak hold can be switched manually or internally between three hold durations: indefinite, 3 seconds or zero. A preferred dual embodiment provides digital implementation driving a pair of LED bar-graph displays side-by-side in vertical or horizontal orientation for stereo applications, and provides selectable display of stereo signals or sum and difference signals. A special peak capture circuit ensures that even very narrow peak levels are indicated at full amplitude despite the controlled ballistic rise rate. Over-range is indicated by a color change of three top display segments.

18 Claims, 7 Drawing Sheets

Model 280-D

LEVEL METER FOR DIGITALLY-ENCODED AUDIO

FIELD OF THE INVENTION

The present invention, in the field of professional audio relates to electronic instrumentation for displaying average and peak audio levels as required in broadcasting, recording and other audio activities.

BACKGROUND OF THE INVENTION

Audio level meters are key elements of instrumentation in those branches of the professional audio field where sound levels must be monitored and controlled. In every practical audio medium whether it be AM or FM broadcast, recording, sound reinforcement or the like, it is an ongoing challenge to exploit the available dynamic range as effectively as possible, and while the particular objectives vary in different media, it is generally paramount to fully utilize available headroom, e.g. for loud passages of music, and yet to prevent peaks from exceeding the inherent over-range threshold that exists in one form or other in every practical sound processing/transducing process, e.g. the 100% modulation point in broadcasting, amplifier clipping, magnetic tape saturation, record groove limitations, etc. In digital audio this threshold generally represents an absolute limit of the amplitude data range.

Along with this basic amplitude limitation of peak level there are usually conflicting requirements relating to the average or persistence level: e.g. preserving artistic loudness dynamics in music, especially classical, minimizing background noise, seeking a balance in loudness perception between music and voice or other variations that might be perceived as by the listener as requiring volume adjustments, attempting to sound louder or more energetic than a competitor, etc.

The well-known standard VU (Volume Unit) meter was defined by a 1961 ANSI specification C 16.5R to have equal rise and fall times of 300 milliseconds: this was based largely on the ballistic limitations of mechanical galvanometers, and serves mainly to indicate the average or persistence level of program material, failing to indicate instantaneous peaks, and thus requires considerable skill, judgement and luck on the part of the operator to prevent peak over-range.

On the other hand, A PPM (Program Peak Meter), long popular in Europe, is directed to displaying capturing and holding peak levels for a selectable period. As defined under EIC specification 268-10 the PPM has a rise time of 10 milliseconds: while this is 30 times faster than the VU meter, it is still may miss some fast audio peaks and thus it still requires a considerable skill and interpretive judgement on the part of an operator. Furthermore it fails to provide the kind of information regarding average or persistence levels of program integration that operators are accustomed to observing on the VU meter.

Some studios have been equipped with mechanical audio level meters of both peak and program-integrating types, i.e. a PPM and a VU meter; however that approach is complex, costly, wasteful of control panel space, and tends to be confusing and fatiguing to an operator. Furthermore, since the inherent ballistic properties of even the most advanced mechanical meters still fall short of ideal instantaneous peak indication, even this dual approach represented a compromise, and there remained much difficulty in reconciling audio levels from different sources.

Near-ideal peak response time, free of such mechanical constraints, has been accomplished in incremental electronic displays such as the bar-graph LED type for indicating dynamic audio levels in replacement of mechanical type meters.

U.S. Pat. No. 4,528,501 to M. L. Dorrough et al for a DUAL LOUDNESS METER AND METHODS is hereby incorporated into the present disclosure by reference: this electronic LED bar-graph type of display for audio monitoring has been successfully pioneered by Dorrough Electronics in a dual loudness meter that displays peak levels and persistence levels simultaneously on a dual bar-graph LED display, and provides for a warning indication of the onset of over-range on each of the dual functions. The Dorrough et al patent teaches summing L and R analog stereo input signals and then full-wave detecting the sum by a precision rectifier which drives two signal paths: (1) a "peak" path including a peak ballistic filtering, lin-log conversion, and an LED display driver which displays peak values in a "dot" graphic mode, and (2) an "average" or "persistence" path including a quasi-average ballistic filtering, lin-log conversion and an LED display driver which drives the peak portion of the LED display in a "bar" graphic mode.

FIG. 1A is a front view of a standard model single-channel analog-sourced audio level meter instrument 10 of known art manufactured by Dorrough Electronics under the above-referenced patent; this model is recognizable by its arched horizontal scale 12, having 40 LED segments in 1 dB steps, the arched form suggesting the appearance and display action of a traditional mechanical analog meter. The major left hand portion of scale 12 is the normal range of the "average" LED bar display, corresponding to the indicating function and operation of the VU meter 14 that represents loudness level as averaged or integrated over a particular time period. This "average" indication is also referred to as persistence, and is related to perceived energy or power content of audio program material, as distinguished from the more transitory peak value. The "average" LED bar is based at the left end of scale 12; its length as indicated by the varying right hand end corresponds to the pointer of a conventional mechanical VU meter 14. The "peak" LED dot display, corresponding to the pointer of a mechanical PPM meter 16, generally indicates to the right of the "average" bar.

FIG. 1B shows the different response characteristics of the "average" and "peak" paths in response to the one second test burst signal shown. It is seen that the "average" display indication of the Dorrough loudness meter, as defined by a ballistic filter, has a rise and fall time of approximately one second compared to 0.3 seconds in a VU meter, while the "peak" display indication is made to have much faster rise time, a designated hold time and relatively fast fall time.

The two displays indications are tracked by adding 3 dB gain to the "average" value so that with a steady state test tone they will indicate the same value. Then with regular program content the difference seen in their behavior yields important operational information: adjusting program level until either the peak or the average over-range point is indicated will result in the maximum usable level regardless of program content. Material with or without compression can easily be matched for the same listening level.

In the trend to digitally-encoded audio, the AES (U.S. based Audio Engineering Society) and the EBU (European Broadcasting Union) have developed standardized specifications, known as the AES/EBU interface, providing considerable flexibility for a variety of specialized applications: in addition to robust formats for the exchange of digital audio information between professional audio devices of different manufacturers, a format for consumer digital devices, which retains compatibility with the AES/EBU professional interface, has been endorsed by the IEC (International Electrotechnical Commission). This allows consumer and professional digital audio machines to be connected together for many purposes, and it increases the utility of a level meter that can be made to readily accommodate some of the remaining variations in digital standards, for example the ability to operate independently of source sampling rate over a range that includes the most common rates 32 kHz, 44.1 kHz and 48 kHz, recommended by AES for PCM purposes.

In summary, the AES/EBU interconnect provides for two multiplexed channels of audio information, which includes modes for two independent channels, left and right stereo channels or mono, periodically sampled and uniformly quantized. The serial digital format is self-clocking and self-synchronizing, and that may be transmitted for short runs over a shielded unbalanced line or for longer runs over a balanced line such as a pair of coaxial shielded audio lines or a shielded a twisted wire pair.

The digital audio data is binary code and utilizes the two's complement system to facilitate arithmetic operations. The maximum audio level is indicated by 111111111: it is normal practice to relate this closely to the over-range threshold point of the system being monitored, thus the loudness meter needs to include an over-range alarm indication closely related to this maximum level for the operator to avoid over-range incidents.

The present invention is directed to utilizing electronic incremental display capability for monitoring the level of audio from sources that are in digitally encoded format, e.g. the AES/EBU standard, up to and including an over-range point.

In addition to the summed stereo mode described above in connection with the patented Dorrough loudness meter, in which the R+L sum (and by default, R, L or monaural) is displayed on a single LED display panel, there are also requirements for the ability to display the levels of the right and left channels simultaneously or by selection and to display the level of the instantaneous difference between the right and left channels.

Notwithstanding the design freedom and flexibility of the massless electronic LED dot/bar graphic display it is subjectively desirable to control ballistic rise and fall rates of the peak dot and average bar in a manner to give a general impression and "feel" of conventional meter movements: there is risk that imposing a desired rise rate limit in the peak display could result in very short peaks being attenuated or missed.

DISCUSSION OF RELATED KNOWN ART

The Dorrough dual audio loudness meter, disclosed in the above-referenced U.S. Pat. No. 4,528,501, is utilized throughout the world in the field of recording and broadcasting, and has become widely accepted as standard in audio monitoring. Electronic level indication of video signal levels was disclosed by Dorrough in U.S. Pat. No. 5,216,492.

Indicating devices operating from digital audio sources have been disclosed in U.S. Pat. No. 4,388,590 to Richards et al, 4,637,047 to Haino, 4,839,584 to Fukuda et al, 4,920,311 to Bateman et al, and in 4,870,349, 4,931,724 and 5,034,680 to Kakuichi et al.

OBJECTS OF THE INVENTION

It is a primary object of the present invention to provide an electronic audio level meter instrument that operates from an audio input signal that is in serial digital format such as the AES/EBU standard.

It is a further object that the level meter instrument display both peak and quasi-average indications of audio signal levels simultaneously and dynamically with predetermined respective different ballistic characteristics.

It is a further object that the apparatus provide visual warning indication of over-ranging of the audio signal levels.

It is a further object that the audio level meter instrument have the capability of displaying the peak and quasi-average levels of instantaneous sum of left and right stereo signals from the digital audio input signal.

It is a further object that the audio level meter instrument have the capability of displaying the peak and quasi-average levels of the right and left stereo signals independently.

It is a further object that the audio level meter instrument have the capability of displaying the peak and quasi-average levels of the instantaneous difference between the left and right stereo signals from the digital audio input signal.

It is a further object to disclose how an audio level meter instrument for digital audio can be implemented through the addition of a digital audio input processing system to an existing audio level meter.

It is a still further object to disclose an audio level meter instrument for digital audio implemented predominantly in digital circuitry wherein various stages of processing can be multiplexed for a pair of stereo channels for a single display device and for two pairs of stereo channels for a dual display device.

It is a still further object to impose a ballistic limit on the rate of rise in the peak display function and yet to display the full amplitude of narrow peaks which, rising faster than the ballistic limit, would ordinarily be missed or attenuated by the ballistic limit.

It is a still further object to provide in the audio level meter instrument a buffered line output port that provides a serial digital audio output signal replicating the serial digital audio input signal.

SUMMARY OF THE INVENTION

The abovementioned objects have been accomplished in an audio level meter instrument having digital audio signal processing circuitry that receives a serial stream of digital stereo audio data in AES/EBU interface format as input and converts it to a pair of logarithmic signals that provide the necessary drive signals for a graphic LED display of ballistically-optimized peak and quasi-average levels displayed independently as a dot and bar graph respectively, with independent over-range alarm on each, indicated by color change of three segments at the high end of the LED display. A special peak-preservation circuit ensures that even very narrow peak levels are indicated at full amplitude despite the controlled ballistic rise rate.

A dual audio level meter in vertical or horizontal orientation provides graphic visual displays representing stereo left and right, or sum and difference.

BRIEF DESCRIPTION OF THE DRAWINGS

The above and further objects, features and advantages of the present invention will be more fully understood from the following description taken with the accompanying drawings in which.

DETAILED DESCRIPTION

Figure 1A:
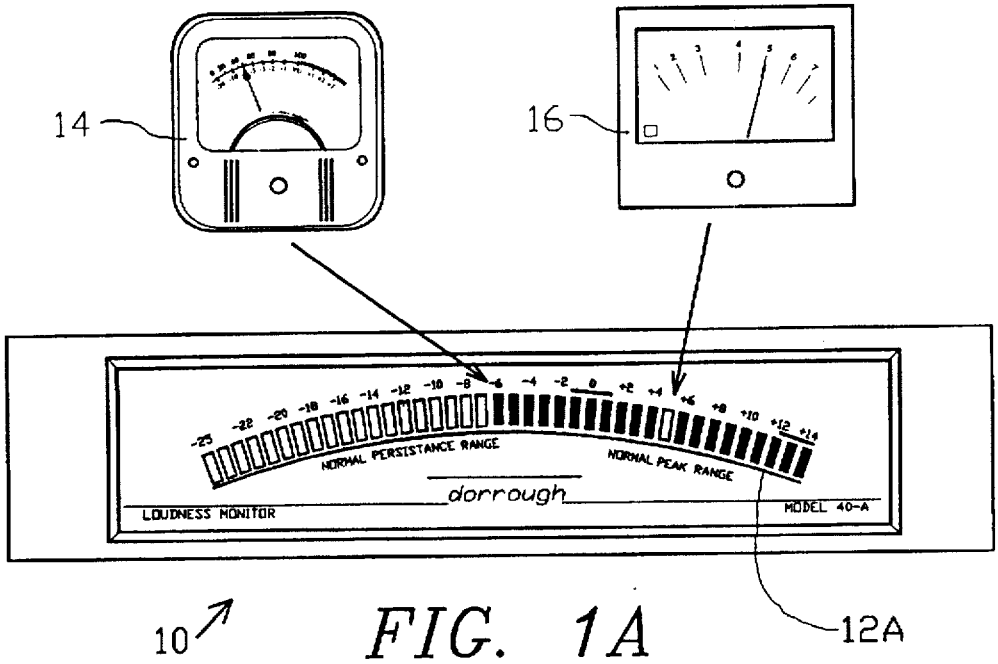
FIG. 1A PRIOR ART
FIG. 1A is a front view of a horizontal arched LED graphic display scale implementation in an audio loudness monitor of known art, showing "average" and "peak" regions related to corresponding conventional mechanical VU and PPM meters.
Figure 1B:
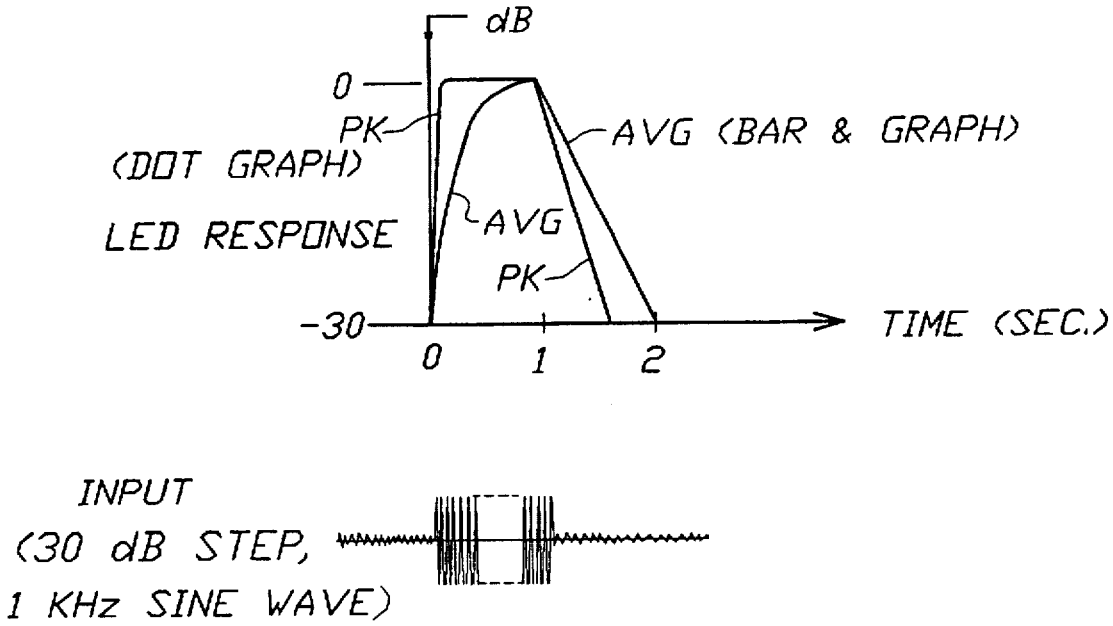
FIG. 1B illustrates the different ballistic "peak" and "average" response characteristics of the loudness monitor of FIG. 1.
Figure 2A:
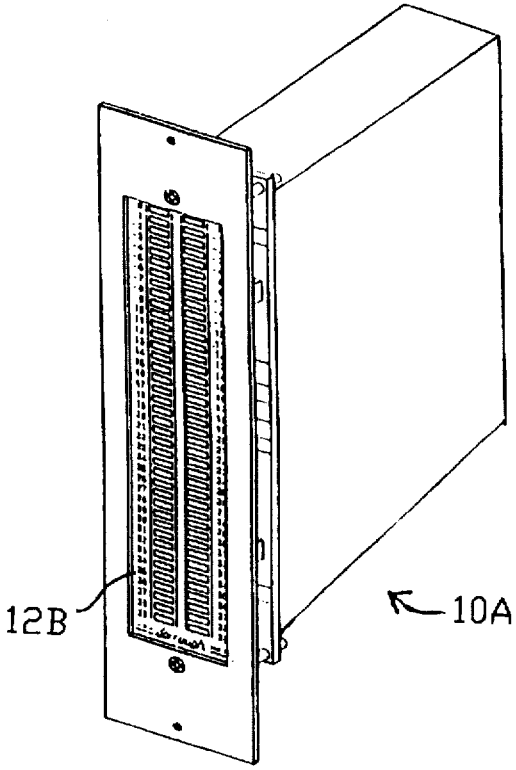
FIG. 2A is perspective view of a panel-mount dual audio level meter instrument embodiment of the present invention, with a dual linear array vertical scale LED graphic display.

FIG. 2A is perspective view of a panel-mount audio level meter instrument embodiment 10A of the present invention, shown with a dual linear array vertical LED graphic display panel 12A having two columns of 40 segments in 1 dB steps.

Figure 2B:
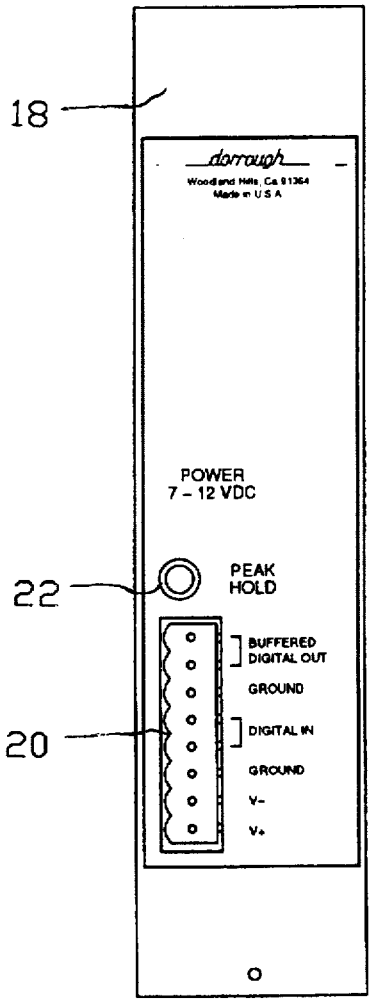
FIG. 2B is a rear view of the subject matter of FIG. 2A.

FIG. 2B is a rear view of the dual digital audio level meter instrument 10A of FIG. 2A, showing the rear panel 18 on which is mounted a Euroconnector receptacle 20 for 7 to 12 volts DC power and digital audio signal input/output. A receptacle 22 is provided for a remote 3 position peak hold selection switch. A similar receptacle may be provided for a Left and Right/Sum and Difference display mode selector switch.

Figure 3A:
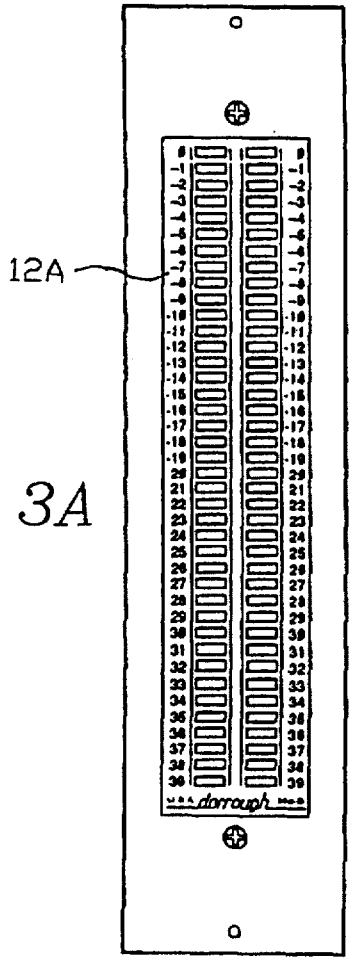
FIGS. 3A–4B show dual 40 segment linear LED graphic displays, for instruments of FIG. 2A, in horizontal/vertical orientation and with 40/60 dB range.

FIG. 3A depicts a dual linear vertical LED graphic display scale implementation 12A providing 40 dB range in 1 dB steps.

Figure 3B:
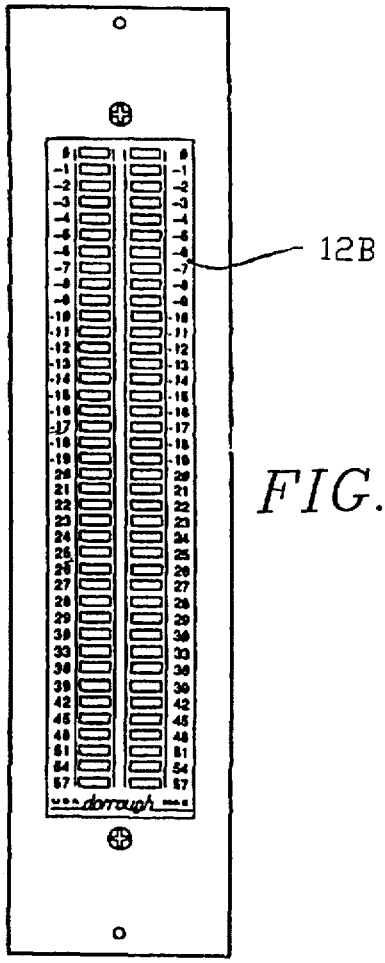

FIG. 3B depicts a dual linear vertical LED graphic display scale implementation 12B providing 60 dB range by making the lower 10 segments to have 3 dB steps as selected by an internal setup jumper in instrument 10A (FIG. 2A).

Figure 4A:
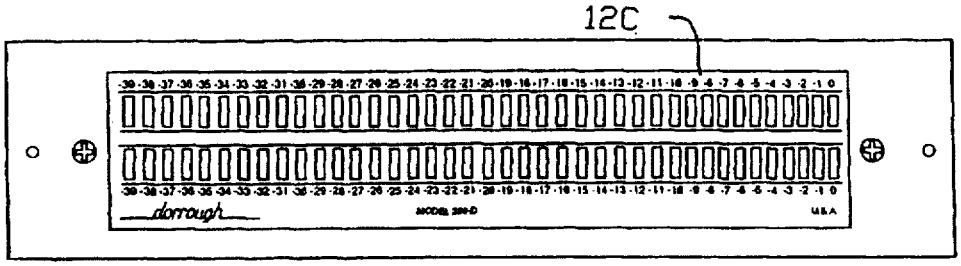

FIG. 4A depicts a dual linear horizontal LED graphic display scale implementation 12C providing 40 dB range in 1 dB steps.

Figure 4B:
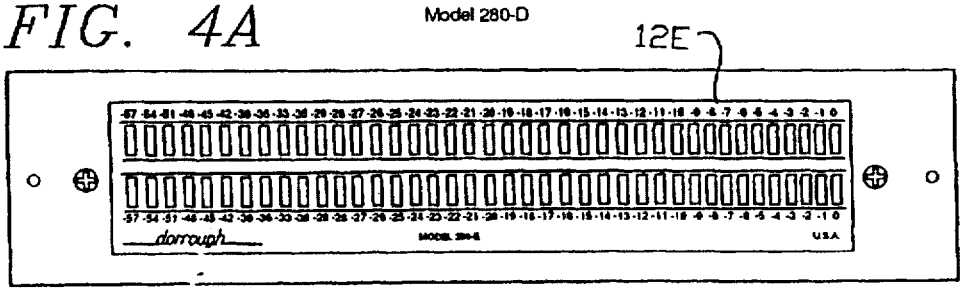

FIG. 4B depicts a dual linear horizontal LED graphic display scale implementation 12D providing 60 dB range by making the lower 10 segments to have 3 dB steps as selected by an internal setup jumper in instrument 10A (FIG. 2A).

As an alternative to the foregoing dual embodiments, a single channel unit could be packaged for utilization alone or in multiples side by side or stacked, or even intermixed with one or more dual units to satisfy particular functional requirements.

Figure 5:
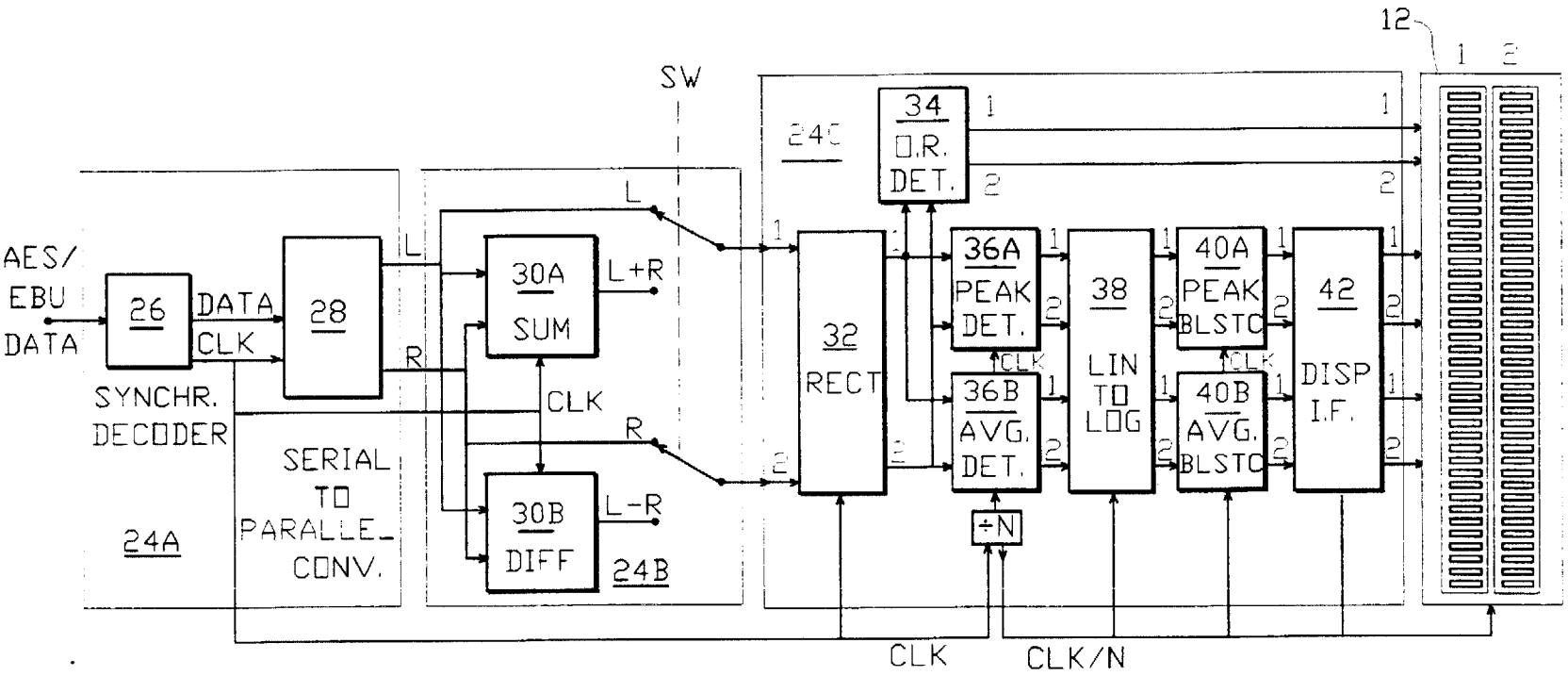
FIG. 5 is a functional block diagram of a digitally-implemented dual stereo audio level meter instrument for operation from a serial digital audio source in accordance with the present invention

FIG. 5 is a functional block diagram of a dual stereo audio level meter instrument for operation from a digital audio source, in accordance with the present invention in a preferred embodiment, that can be implemented partially or entirely with digital circuitry.

Four major functional circuit entities are shown: digital input signal decoder 24A, sum/difference processor/selector 24B, a dual stereo channel display signal processor 24C, and a dual display unit 24D.

The incoming serial digital audio signal is applied (via an input interface, refer to FIG. 6A) to a input clock/data recovery circuit 26 which acts on the input signal to recover a serial audio data signal and a clock signal at a designated sample rate. The clock and data signals are applied to serial-to-parallel converter 28 which derives left and right signals L and R in parallel digital format and a stabilized clock signal.

From this point, it would be possible to implement the balance of the functions of FIG. 5 with analog circuitry for performing the display signal processing functions shown; e.g. a pair of analog-input electronic-display audio level meters of known art or a dual display unit, receiving analog inputs from the L and R parallel digital signals via D/A converters.

In the digitally-implemented dual embodiment of FIG. 5, it should be understood the four indicated signal flow paths shown following block 32 (two basic channels indicated as 1 and 2 each with average and peak subchannels) are actually implemented sequentially through time multiplexing of the four paths into a single serial data path, timed from the clock signal CLK and subrate clock CLK/N signals shown.

In module 24B, with switch SW in the position shown, the L and R signals are selected as the subject signals directed to the input of rectifier block 32. In the other position of switch SW, the sum signal L+R and the difference signal /L–R/ are selected as the subject signals. Note: /L–R/ can be either L–R or R–L, since in either case the polarity sign will be eliminated in the subsequent rectification process which converts the signal to an absolute value.

The summing function in block 30A is readily accomplished by digital addition of the L and R data values. With simple digital subtraction for the difference function in block 30B the cancellation under the test condition where R=L will be less than ideal due to non-synchronous sampling rate effects; for greater cancellation, it may be necessary to interpolate the digital audio data. As a possible alternative, the sum and/or difference functions of blocks 30A and 30B could be performed with analog circuitry having D/A and A/D conversions at the inputs and outputs respectively.

In rectifier block 32 the audio data of the subject signals (L and R, or sum and difference) is full-wave rectified. Since the digital format is 2's complement, rectification is accomplished by inverting all the bits of the sample if the MSB is binary 1.

In over-range detector block 34, which receives as inputs the rectified subject signals from the rectifier block 32, the maximum level available at full range of the digital audio system is defined by the binary signal from rectifier block 32 becoming all 1's (111111111). The warning level may be set conservatively to act at a designated number of counts under the maximum level, or more liberally to act only after a designated number of consecutive samples are detected at full range point. Typically the factory-setting is specified, and instructions are provided for changing the warning level, e.g. by removing a setup jumper.

The two rectified signal channels 1 and 2 from rectifier block 32 are applied to peak detector 36A and to average detector 36B, thus providing four signal entities: a peak signal and an average signal in each channel, 1 and 2.

In the "peak" path, peak detector 36A generates a detected peak value representing the highest amplitude found in each successive group of 32 audio data samples. The peak may be as narrow as one data sample wide, e.g. 22.7 microseconds. A continuous series of such detected "peak" values is delivered by block 36A to lin-log (linear-to-logarithmic) converter block 38, where the linear "peak" values (and the linear "average" values) are converted to logarithmic values; support is provided for both 40 dB and 60 dB display scales as described above, selectable by a setup jumper.

In the "peak" ballistic box 40A, constraints are imposed on the response speed of the "peak" display such that a display peak value, indicated by the LED dot mode display, is made to increment at a rate of one dB every 32 samples and decrease at a rate that is eight times slower: one dB every 256 samples. Thus at 44.1 kHz clock rate, the rise time for 40 dB full scale is 32*40/44100=0.029 seconds and the fall time is 8*0.029=0.232 seconds.

The displayed peak reading may be held for a predetermined time period depending on the peak hold mode selected by a three position user switch plugged into receptacle 22 (FIG. 2B), or by an internal setup jumper. In the preferred embodiment, the peak mode is selectable from three available modes:

(1) permanent peak hold: the highest peak value will be displayed indefinitely until manually reset by changing the peak hold mode or depowering the instrument;

(2) three second automatic hold: the highest peak value will be held and displayed for a designated period, e.g. three seconds, then automatically reset to decrease at the preredetermined ballistic rate pending the onset of the next peak; and (3) permanent reset: peak display not held.

As a matter of design choice, one or more additional designated automatic peak hold time values could be provided.

For ensuring display of narrow spike peaks despite the aforementioned ballistic constraint on "peak" rise rate, a peak capture logic circuit is provided in peak ballistic block 40A wherein a floating "goal" value register acts as an intermediary between the "detected" peak value and the "display" value. With peak hold disabled, the peak capture logic circuit operates as follows:

The "goal" value is compared with the "detected" value and with the "display" value every 32 samples (i.e. every 0.000,728 seconds @ 44.1 kHz). As long the "goal" value exceeds the "display" value, the "goal" value is held at the highest previous "detected" value, and the "display" value increments at the predetermined rise rate until it reaches the "goal" value whereupon the "goal" value is allowed to drop immediately and to "ride" the "detected" peak values; meanwhile as long as the "display" value exceeds the "goal" value, it decrements at the predetermined fall rate until it falls below the "goal" value, else/then the foregoing sequence repeats. Thus a fast audio peak that rises faster than the peak display ballistic limit, and would ordinarily be lost or attenuated, is captured and displayed at full value after a short time delay; since this delay will not exceed 30 milliseconds, it is not critical.

In the "average" process path, detector block 36B is made to generate successive "average" data values each representing the average of the most recent group of 512 audio data samples. After lin-log conversion in block 38, constraints are imposed on the response speed of the "average" bar graph displays in the "average" ballistic box 40B such that each "average" display is allowed to move up and down at the maximum rate of 1 dB for each "average" data value received. With a 44.1 kHz sampling rate, the rise or fall time for the full 40 dB range "average" display will be 40*512/44,100=0.465 seconds; there will be some variation in this response rate depending on the choice of sampling rate (32, 44.1 or 48 kHz)

As an example of the "average" response: if the currently displayed value was −20 dB, and the next average of 512 samples is −10 dB, the displayed "average" value would increase to −19 dB. If the next average of 512 samples was still above −19 dB the displayed value would then increase to −18 dB, etc.

The output data of both channels 1 and 2 of ballistic circuits 40A and 40B are supplied as input to display interface 42, which delivers the display data in serial format to the display unit 12, which includes driving logic particular to the LED arrays. Thus the logarithmic ballistically-conditioned average and peak signals of the two channels actuate the corresponding average bar graph and peak dot graph display function of each array in display unit 12.

Figures 1, 6A:
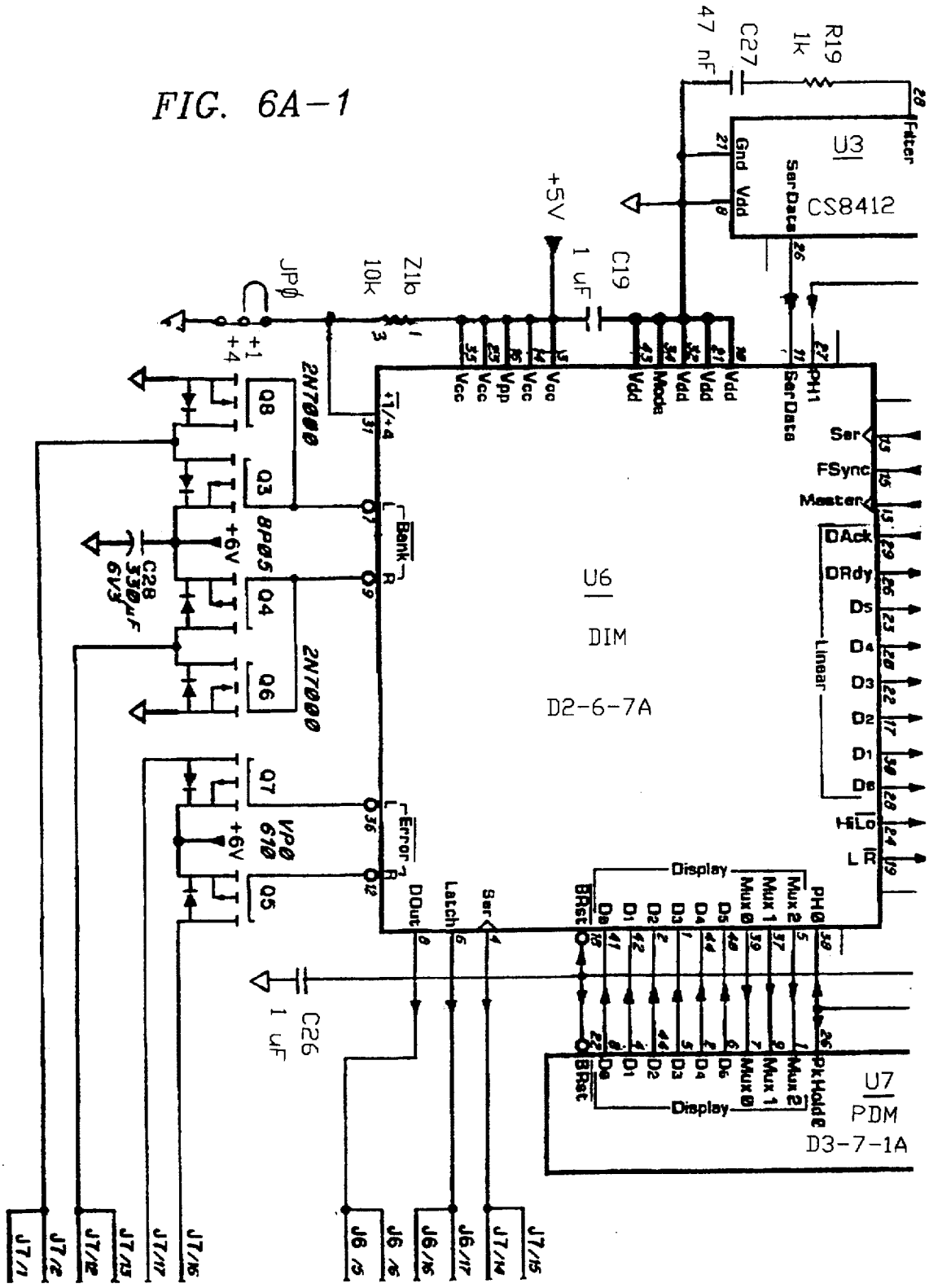
FIG. 6A is a schematic diagram of a dual stereo audio level meter instrument implemented digitally in accordance with FIG. 5, in a preferred embodiment of the present invention .
Figures 2, 6A:
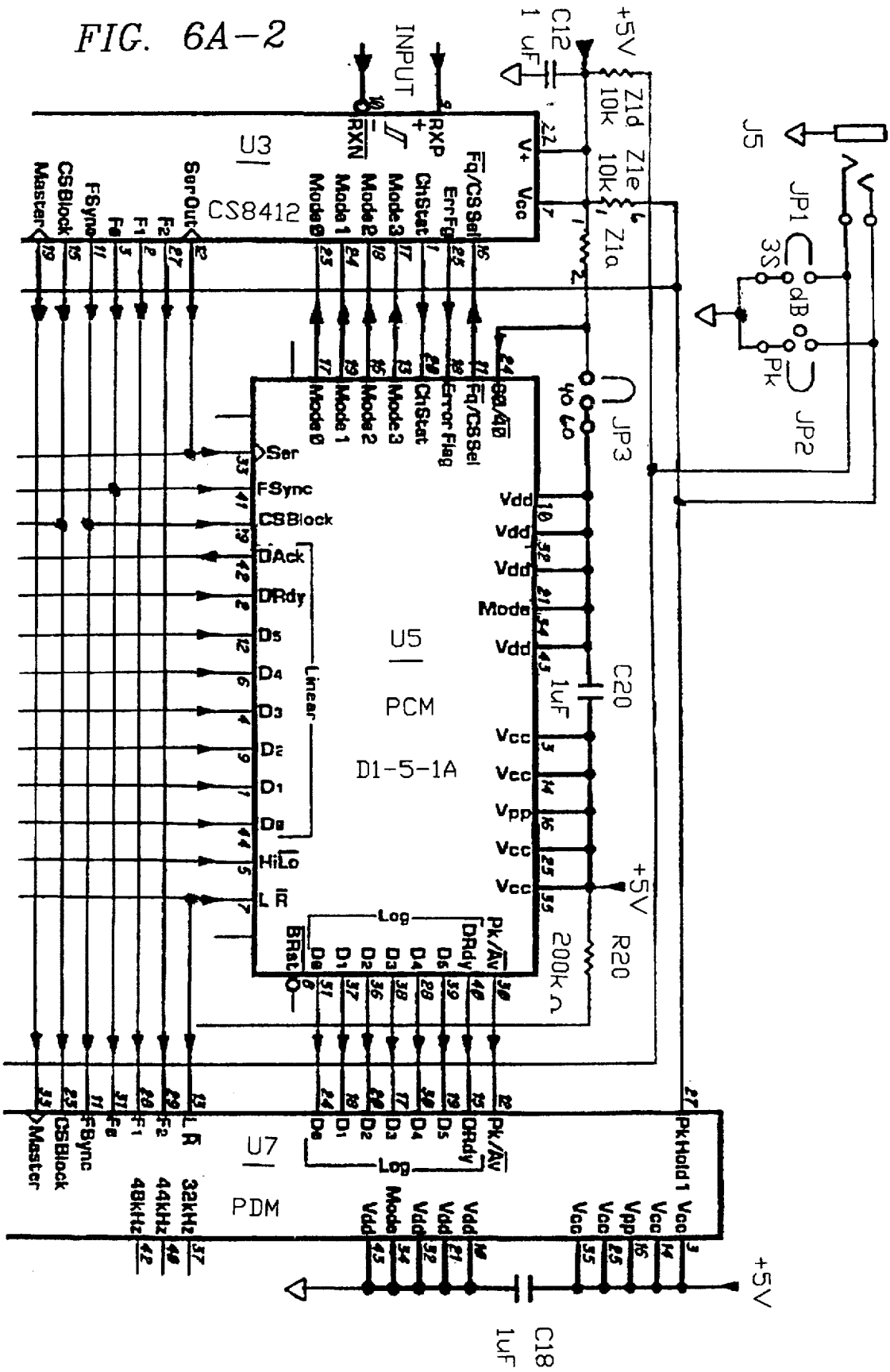

FIG. 6A is a schematic diagram of signal processor circuitry implemented by custom IC chips encompassing the process functions shown in FIG. 5. The signal input is received (via an input buffer: refer to FIG. 6B) at terminals 9 and 10 of IC chip U3 at the upper left side of FIG. 6C; the processed serial display drive output is delivered at connector J6/J7 at the lower right hand corner of FIG. 6A.

Chip U3, which performs the functions of block 26 in FIG. 5, is implemented by a CS8412 chip, manufactured by Crystal Electronics, is set up to receive an AES/EBU signal as recommended by AES for PCM (pulse code modulation).

Chips U5, U6 and U7 are field programmable gate arrays; each may be implemented by an Actel device type 1020 which is programmable by commercially available services to perform the required functions as defined heretofore.

Chip U5, designated PCM (process control module), performs control functions including serial-parallel conversion, rectification, detection and lin-log conversion functions of blocks 28, 32, 34, 36A, 36B, and 38 (FIG. 5).

In an alternative embodiment, the sum/difference functions of blocks 30A and 30B and switch SW may be omitted, making L and R the subject signals; otherwise IC chip U5 may be made to perform these functions.

Chip U7 designated PDM (process display module) performs the display average and peak ballistic shaping functions of blocks 40A and 40B (FIG. 5).

Chip U6 designated DIM (display interface module) interfaces with the display, providing the display-driving function of blocks 42A and 42B (FIG. 5), and operates in conjunction with FET bilateral switches Q3–Q8 and associated circuitry to implement such functions as over-range detection and indication in block 34 (FIG. 5). The drive signal processing for each array of display unit 12 (FIG. 5) operates in a sequential alternating mode controlled by multiplexing and shift register circuitry in chip U6.

Figure 6B:
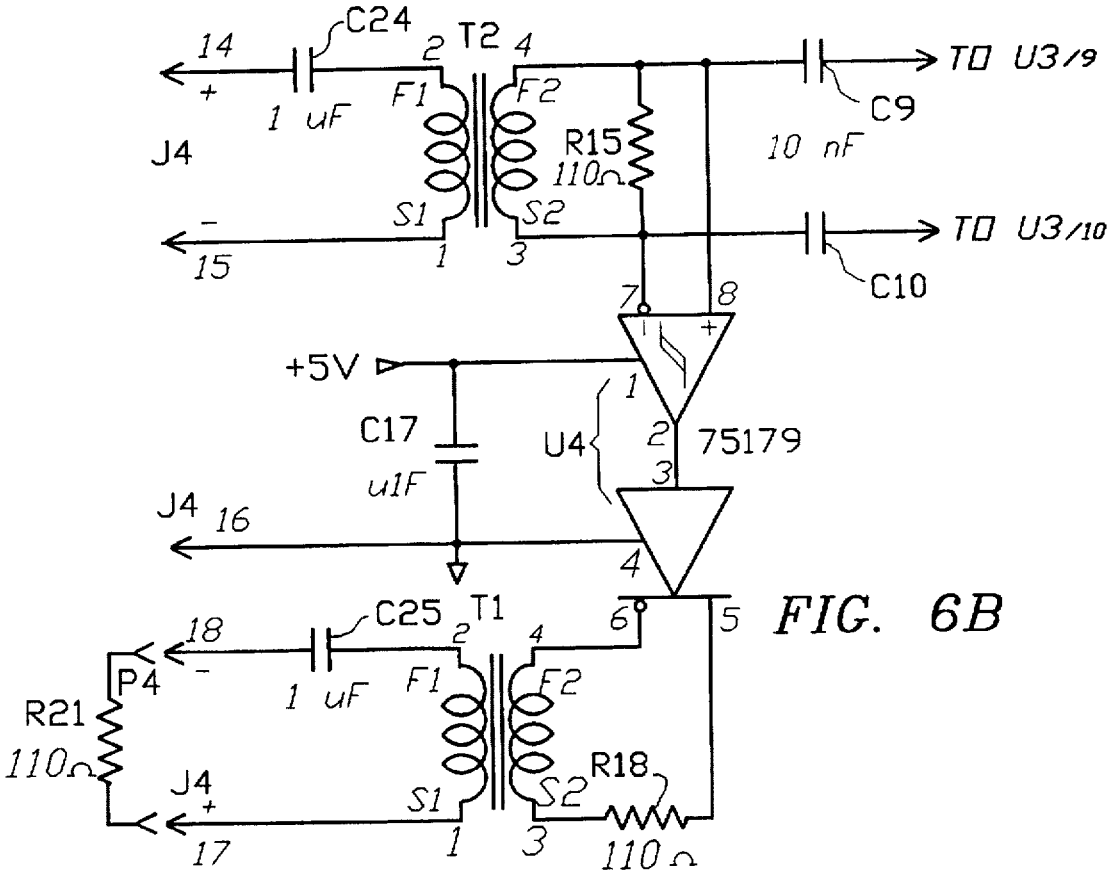
FIG. 6B is a schematic diagram of an AES/EBU serial digital audio input/output interface circuit, in connection with the digitally-implemented audio level meter instrument of FIG. 6A.

FIG. 6B is a schematic diagram of a digital input/line output interface buffer that is located at the signal input port of the illustrative embodiment (FIG. 6A) of the audio level meter instrument of the present invention. The digital input signal is received at jack J4 and is coupled to the primary of input transformer T2 by capacitor C24. The input line can be unbalanced for short runs or of a balanced type for longer runs. The input signal is DC- isolated by transformer T2 whose secondary is coupled by capacitors C9 and C10 to input of the processor (terminals 9 and 10 of U3, FIG. 6A), and is also connected to the input of buffer U4, implemented by IC type 75179 which provides a line output, via primary series resistor R18 (110 ohms), transformer T1 and secondary series capacitor C25, at terminals 17 and 18. This line output is shown terminated with a dummy load resistor R21 (110 ohms) which is provided in place with the unit as delivered, to be removed when the line output is terminated by connected to other equipment.

Figure 6C:
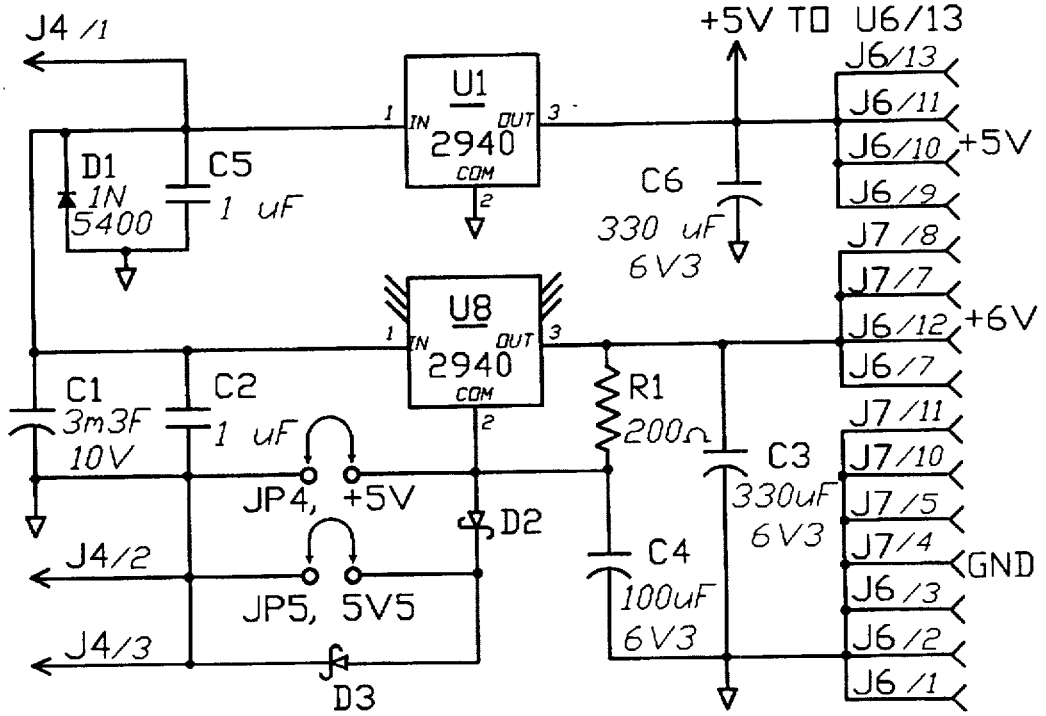
FIG. 6C is a schematic diagram of the power supply portion of the digitally-implemented audio level meter instrument described in FIGS. 6A and 6B.

FIG. 6C is a schematic diagram of a power supply circuit for powering the elements of the illustrative embodiment of the present invention shown in FIGS. 6A and 6B. Regulator ICs U1 and U8, implemented by IC type 2940, provide voltage-regulated power to the +5 volt and +6 volt buses respectively.

The principles disclosed above for a digitally implemented two channel audio level meter can be readily applied to a single channel audio level meter embodiment with a single array display device, e.g. dedicated to L, R or sum, selectable or hard wired.

Some or all of the above described process functions could be performed alternatively by other means such as a microprocessor.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An audio level meter instrument comprising:

an input electronic processing circuit, receiving an input digital audio signal in serial format representing data of a stereophonic audio signal sampled at a predetermined sampling rate, constructed and arranged to derive therefrom an L signal representing left channel audio data and an R signal representing right channel audio data;

a sum processing circuit, receiving as input the L signal and the R signal, constructed and arranged to provide as output an L+R signal representing an instantaneous sum of the R and L signals;

a display signal processor, receiving as input a subject signal, selected from a group including the L signal, the R signal and the L+R signal, constructed and arranged to process the subject signal in a manner to provide a logarithmic average display drive signal and a logarithmic peak display drive signal, having respective predetermined different ballistic properties;

rectifier electronic processing circuitry means, in said display signal processor and receiving the subject signal, constructed and arranged to act thereupon to apply full-wave rectification to audio data of the subject signal and to thus provide as output a rectified signal representing the audio data of the subject signal in rectified form;

a display drive electronic processing circuit, in said display signal processor and receiving as input the rectified signal, constructed and arranged to act thereupon in a manner to provide as output, an average logarithmic ballistically-conditioned display driving signal representing guasi-average amplitude values of the rectified signal and a peak logarithmic ballistically-conditioned display driving signal representing peak amplitude values of the rectified signal, the two display driving signals being applied to said electronic display device in a manner to enable simultaneous display of quasi-average and peak levels in a co-related and distinguishable manner along a common meter scale;

a digital average detecting process circuit, in said display drive electronic processing circuit and receiving as input the detected signal, constructed and arranged to monitor successive average groups of data thereof each average group containing a predetermined number of audio data samples and to provide therefrom a digital average signal representing the average amplitude of audio data samples contained in each average group;

linear-to-logarithmic conversion means, in said display drive electronic processing circuit and receiving as input the average signal, constructed and arranged to convert linear data of the average signal to logarithmic average data;

a digital average ballistics process circuit, in said display drive electronic processing circuit and receiving as input the logarithmic average data, constructed and arranged to impose a predetermined rise and fall times upon said logarithmic average data and to thus provide the logarithmic ballistically-conditioned average signal;

an electronic display device, receiving as input the display drive signals, constructed and arranged to visually display independent average and peak representations of audio data of the subject signal; and display drive circuit means, in said display drive electronic processing circuit and receiving as input the ballistically-conditioned average signal, constructed and arranged to operate said display device in a manner to provide a visual logarithmic ballistically-conditioned average display of the subject signal.

2. The audio level meter instrument as defined in claim 1 wherein said input electronic processing circuit comprises:

a clock/data recovery circuit, receiving the input serial digital audio signal, constructed and arranged to process the input signal and to provide therefrom as output a clock signal at the predetermined sampling rate, and a replicated serial audio data signal; and a serial-to-parallel converter receiving as input the clock signal and the replicated serial audio data signal and providing as output the L and R signals representing the left and right audio signal data in parallel digital format.

3. The audio level meter instrument as defined in claim 1 further comprising signal selector means, receiving as inputs the L signal, the R signal and the L+R signal, constructed and arranged to enable a user to select one of the three inputs as the subject signal.

4. The electronic audio level meter instrument as defined in claim 1 wherein said electronic display device comprises a one-dimensional array of LED segments constructed and arranged to display average values in bar graph form and to display peak values in dot graph form.

5. The electronic audio level meter instrument as defined in claim 4 further comprising;

over-range warning detection means constructed and arranged to monitor audio data of the subject signal, to detect therefrom occurrences of predetermined proximity of audio level data to a predetermined maximum audio level limit of the digital audio format and to consequently generate an over-range warning signal; and said display device, receiving as an input the over-range warning signal, being further constructed and arranged to respond to the over-range warning signal by causing a color change to red in three LED segments disposed at a top scale region of said display device.

6. The audio level meter instrument as defined in claim 1 wherein:

the successive average groups of data are each made to contain 512 samples of data; and the predetermined rise and fall rates of the logarithmic average signal are made to be 1 db per 512 samples of data.

7. The audio level meter instrument as defined in claim 1 wherein said rectifier electronic processing circuitry comprises digital processing circuitry constructed and arranged to act upon the data of the subject signal in a manner to apply full-wave rectification thereto and to provide the output rectified signal in parallel digital format representing audio data of the subject signal in rectified form.

8. The audio level meter instrument as defined in claim 7 wherein said display drive electronic processing circuit means further comprises;

a digital peak detecting process circuit receiving as input the rectified signal, constructed and arranged to monitor successive groups of audio data samples thereof, each group containing a predetermined number of audio data samples, and to provide therefrom a parallel digital detected peak signal representing maximum amplitude audio data found within each peak group;

said linear-to-logarithmic conversion means being constructed and arranged to convert said detected peak signal from a linear-valued signal to a logarithmic peak signal;

a peak ballistics circuit constructed and arranged to process said logarithmic peak signal in a manner to impose predetermined different rise and fall times thereupon and thus provide a digital ballistically-conditioned peak signal; and said display drive circuit means, receiving the ballistically-conditioned peak signal, being further constructed and arranged to operate said display device in a manner to provide a visual logarithmic ballistically-conditioned peak display of the subject signal.

9. The electronic audio level meter instrument as defined in claim 8 further comprising:

a peak hold selection switch constructed and arranged to cooperate with said first and second peak detector circuits so as to provide user capability of selecting between at least three modes of different hold time duration of peak level indication including a mode of infinite hold time, a mode of predetermined hold time, and a mode of zero hold time.

10. The electronic audio level meter instrument as defined in claim 9 wherein the predetermined hold time is made to be within a range between two seconds and four seconds.

11. The electronic audio level meter instrument as defined in claim 10 wherein:

the successive peak groups of data are each made to contain 32 samples of data;

the predetermined rise rate of the logarithmic peak signal is made to be one dB per 256 samples of data; and the predetermined fall rate of the logarithmic peak signal is made to be one dB per 32 samples of data.

12. The electronic audio level meter instrument as defined in claim 8 wherein said peak ballistic circuit further comprises a peak capture circuit constructed and arranged to ensure that peaks of short duration are displayed at full amplitude despite the predetermined peak display rise rate imposed by said peak ballistic circuit, said peak capture circuit having a goal value register and associated logic circuitry constructed and arranged to temporarily store fast-rise peak detected values as goal values for subsequent display as peak display values, said logic circuitry operating in accordance with the following conditions:

the goal value is repeatedly compared to the detected value and the display value; the goal value holds at the highest previous detected value as long the goal value exceeds the display value, meanwhile the display value increments at the predetermined rise rate until it reaches the goal value whereupon the goal value is free to drop and hold at the next detected peak value; meanwhile if the display value exceeds the goal value, it decrements at the predetermined fall rate until it falls below the goal value, else/then the foregoing sequence repeats.

13. The electronic audio level meter instrument as defined in claim 1 further comprising:

a difference processing circuit, receiving as input the L signal and the R signal, constructed and arranged to provide as output an /L–R/ signal representing an instantaneous difference between the L and R signals; and a selector switch constructed and arranged to receive as input the L signal, the R signal, the L+R signal and the /L–R/ signals and to provide as output, and thus cause to be displayed, the subject signal as selected by the user from the four input signals.

14. An audio level meter instrument comprising:

an input clock/data recovery circuit receiving an input serial digital audio signal and providing as output a clock signal at a predetermined sampling rate, selected from a group including 32 kHz, 44.1 kHz and 48 kHz, and a reconstituted serial audio data signal;

a serial-to-parallel converter receiving as input the clock signal and the serial audio data signal and providing as output L and R signals representing the left and right audio signals respectively;

a sum processing circuit, receiving as input the L signal and the R signal, constructed and arranged to provide as output an L+R signal representing an instantaneous sum of the R and L signals;

a difference circuit, receiving as input the L signal and the R signal, constructed and arranged to provide as output an /L–R/ signal representing an instantaneous difference between the L and R signals;

a selector switch constructed and arranged to receive as input the L signal, the R signal, the L+R signal and the /L–R/ signals and to provide as output, and thus cause to be displayed, the subject signal as selected by the user from the four input signals;

rectifier electronic processing circuitry constructed and arranged to act upon the data of the subject signal in a manner to apply full-wave rectification thereto and to provide a rectified signal representing audio data of the subject signal in rectified form;

an average detecting process circuit receiving as input the rectified signal, constructed and arranged to provide an average signal representing a quasi-average amplitude of the rectified signal;

an average ballistics process circuit, receiving as input the average signal, constructed and arranged to impose a predetermined rise and fall times upon the average signal and to thus provide a ballistically-conditioned average display drive signal;

a peak electronic processing circuit, receiving as input the rectified signal, constructed and arranged to act thereupon in a manner to provide a peak display drive signal representing peak amplitude levels of the rectified signal;

a peak ballistics process circuit, receiving as input the peak signal, constructed and arranged to impose a predetermined rise and fall times upon the peak signal and to thus provide a ballistically-conditioned peak display drive signal;

an electronic display device, receiving as input the ballistically-conditioned average and peak display drive signals, comprising a one-dimensional array of LED segments constructed and arranged to display average values in bar graph form and to display peak values in dot graph form as independent representations of corresponding audio data of the subject signal;

over-range warning detection means constructed and arranged to monitor audio data of the subject signal, to detect therefrom occurrences of predetermined proximity of audio level data to a maximum audio level limit of the digital audio format and to consequently generate an over-range warning signal, said display device, receiving as an input the over-range warning signal, being constructed and arranged to respond thereto by causing a distinctively recognizable color change in three LED segments disposed at a top scale region of said display device.

15. A dual audio level meter instrument comprising:

an input clock/data recovery circuit receiving an input serial digital audio signal and providing as output a clock signal at a predetermined sampling rate, selected from a group including 32 kHz, 44.1 kHz and 48 kHz, and a reconstituted serial audio data signal;

a serial-to-parallel converter receiving as input the clock signal and the serial audio data signal and providing as output L and R signals representing the left and right audio signals respectively;

a sum processing circuit, receiving as input the L signal and the R signal, constructed and arranged to provide as output an L+R signal representing an instantaneous sum of the R and L signals;

a difference processing circuit, receiving as input the L signal and the R signal, constructed and arranged to provide as output an /L–R/ signal representing an instantaneous difference between the L and R signals;

selector means constructed and arranged to receive as input the L signal, the R signal, the L+R signal and the /L–R/ signals and to select as output, and thus cause to be displayed, a pair of subject signals as selected by the user from the following two pairs: (a) the L signal and the R signal and (b) the L+R signal and the \L–R\ signal;

rectification process means, receiving as input the pair of subject signals, constructed and arranged to act upon data thereof in a manner to apply full-wave rectification thereto and to thus provide a pair of rectified signals representing audio data of the subject signals in rectified form;

an average detection process circuit receiving as input the pair of rectified signals, constructed and arranged to provide a pair of average signals each representing a quasi-average amplitude of the corresponding rectified signal;

a peak detection process circuit, receiving as input the pair of rectified signals, constructed and arranged to act thereupon in a manner to provide a corresponding pair of peak signals representing peak amplitude levels of the corresponding rectified signals;

linear-to-logarithmic conversion means, receiving as inputs data of the pair of average signals and the pair of peak signals, constructed and arranged to convert input data from linear to logarithmic form and to provide as output a pair of logarithmic average signals and a pair of logarithmic peak signals;

an average ballistics process circuit, receiving as input the pair of logarithmic average signals, constructed and arranged to impose a predetermined rise and fall times upon the logarithmic average signals and to thus provide a corresponding pair of ballistically-conditioned logarithmic average display drive signals;

a peak ballistics process circuit, receiving as input the pair of logarithmic peak signals, constructed and arranged to impose predetermined rise and fall times upon the logarithmic peak signals and to thus provide a corresponding pair of ballistically-conditioned logarithmic peak display drive signals;

a dual electronic display device, receiving as input the pair of ballistically-conditioned logarithmic average signals and the pair of ballistically-conditioned logarithmic peak display drive signals, comprising a dual array of LED segments constructed and arranged to each display average values in bar graph form and to display peak values in dot graph form on each corresponding array as independent representations of corresponding audio data of the respective subject signals;

over-range warning detection means constructed and arranged to monitor audio data of each of the subject signals, to detect therefrom occurrences of predetermined proximity of audio level data to a maximum audio level limit and to consequently generate an over-range warning signal, said display device, receiving as an input the over-range warning signal, being constructed and arranged to respond thereto by introducing a visually recognizable color change in three LED segments disposed at a top scale region of the corresponding array of said display device.

16. The dual electronic audio level meter instrument as defined in claim 15 wherein said rectification process means, said average detection process circuit, said linear-to-logarithmic conversion means said average ballistics process circuit, said peak detection process circuit, and said peak ballistics process circuit are constructed utilizing programmable gate arrays and arranged to perform corresponding processing in a digital manner wherein the two subject signals along with respective average and peak versions thereof are processed in time-multiplexed manner.

17. The dual electronic audio level meter instrument as defined in claim 16, wherein:

said average detection process circuit, receiving as input the pair of rectified signals, is constructed and arranged to detect and provide as output the pair of average signals, averaged from each successive average group of a predetermined number of samples of data, representing a quasi-average amplitude of the rectified signal;

said peak detection process circuit, receiving as input the rectified signals, is constructed and arranged to monitor successive peak groups of audio data samples thereof, each peak group containing a predetermined number of samples of audio data, and to provide therefrom the pair of parallel digital detected peak signals representing maximum amplitude audio data found within each peak group of each of the two subject signals.

18. The dual electronic audio level meter instrument as defined in claim 17 wherein:

the rise and fall times of the average signal are made to be 1 db per 512 samples of data;

the rise time of the peak signal is made to be one dB per 256 samples of data; and the fall rate of the peak signal is made to be one dB per 32 samples of data.

* * * * *